US006083031A

United States Patent [19]

Kuo

[11] Patent Number: 6,083,031

[45] Date of Patent: Jul. 4, 2000

[54] CABLE END CONNECTOR

[75] Inventor: Peter Kuo, Chung-Ho, Taiwan

[73] Assignee: Hon Hain Precision Ind. Co., Ltd., Taipei Hsien, Taiwan

[21] Appl. No.: 09/318,234

[22] Filed: May 25, 1999

[30] Foreign Application Priority Data

Dec. 11, 1998 [TW] Taiwan ..... 87220687

[51] Int. Cl.[7] ..... H01R 13/627

[52] U.S. Cl. ..... 439/362; 439/465; 439/610

[58] Field of Search ..... 439/362, 378, 439/465, 610, 585

[56] References Cited

U.S. PATENT DOCUMENTS

| | | | |
|---|---|---|---|
| 4,108,527 | 8/1978 | Douty et al. | 439/465 |
| 4,398,780 | 8/1983 | Novotny et al. | 439/284 |
| 4,678,259 | 7/1987 | Petit | 439/610 |
| 4,822,286 | 4/1989 | Bianca | 439/610 |
| 4,838,808 | 6/1989 | Fujiura | 439/357 |
| 4,842,543 | 6/1989 | Davis | 439/378 |
| 4,966,560 | 10/1990 | Marzouk | 439/585 |
| 4,998,892 | 3/1991 | Shiley | 439/381 |
| 5,190,475 | 3/1993 | Dickens | 439/588 |
| 5,271,739 | 12/1993 | Denlinger et al. | 439/466 |
| 5,338,227 | 8/1994 | Nakamura | 439/607 |
| 5,342,216 | 8/1994 | Davis et al. | 439/362 |
| 5,391,091 | 2/1995 | Nations | 439/378 |
| 5,501,616 | 3/1996 | Holliday | 439/585 |
| 5,920,459 | 7/1999 | Weber et al. | 439/752 |

*Primary Examiner*—Neil Abrams
*Assistant Examiner*—Hae Moon Hyeon
*Attorney, Agent, or Firm*—Wei Te Chung

[57] ABSTRACT

A cable end connector includes an insulative outer casing defining an interior space therein for accommodating a metallic inner casing securely fixed in the outer casing. An insulative connector body receiving and retaining a number of contact elements therein is received in the outer casing and exposed through an opening defined in a side wall thereof for engaging with a mating connector. The connector has a positioning pin and a bolt extending beyond the side wall for respectively engaging with a plain hole and a screw hole defined in the mating connector thereby securing the cable end connector to the mating connector. A leading end of a cable extends into the outer casing and is electrically connected to the contact elements. The cable is mechanically fixed to the inner casing by permanently deforming the inner casing thereby effectively resisting an external force transmitted through the cable and protecting interior parts of the connector.

14 Claims, 3 Drawing Sheets

CABLE END CONNECTOR

BACKGROUND OF THE INVENTION

1. Field of the Invention

The present invention generally relates to a cable end connector, and in particular to a cable end connector easily engaged with a mating connector, which protects interior parts thereof from being damaged by an external load transmitted through a cable connected thereto.

2. The Prior Art

A cable provides electrical connection between two electrical devices. A cable end connector connects the cable to the electrical device usually by engaging with a mating connector mounted in the electrical device. An example of a cable end connector is disclosed in U.S. Pat. No. 5,271,739 which does not teach any technique to protect interior parts of the connector when the connector is subject to an external load transmitted through a cable connected thereto. Another cable end connector is disclosed in U.S. Pat. No. 5,190,475 which requires tightening two bolts in order to secure the cable end connector to a mating connector. However, such a method is inconvenient when mating and securing the two connectors.

It is thus desirable to have a cable end connector that eliminates the disadvantages associated with the prior art cable end connector.

SUMMARY OF THE INVENTION

Accordingly, an object of the present invention is to provide a cable end connector that is easily engaged with a mating connector by tightening a single bolt.

Another object of the present invention is to provide a cable end connector that protects interior parts thereof from being damaged or displaced by an external force transmitted through a cable connected thereto.

To achieve the above objects, a cable end connector in accordance with the present invention comprises an insulative outer casing defining an interior space therein for accommodating a metallic inner casing securely fixed in the outer casing. An insulative connector body receiving and retaining a number of contact elements therein is received in the outer casing and exposed through an opening defined in a side wall thereof for engaging with a mating connector. The connector has a positioning pin and a bolt extending beyond the side wall for respectively engaging with a plain hole and a screw hole defined in the mating connector thereby securing the cable end connector to the mating connector. A leading end of a cable extends into the outer casing and is electrically connected to the contact elements. The cable is mechanically fixed to the inner casing by permanently deforming the inner casing thereby effectively resisting an external force transmitted through the cable and protecting interior parts of the connector.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
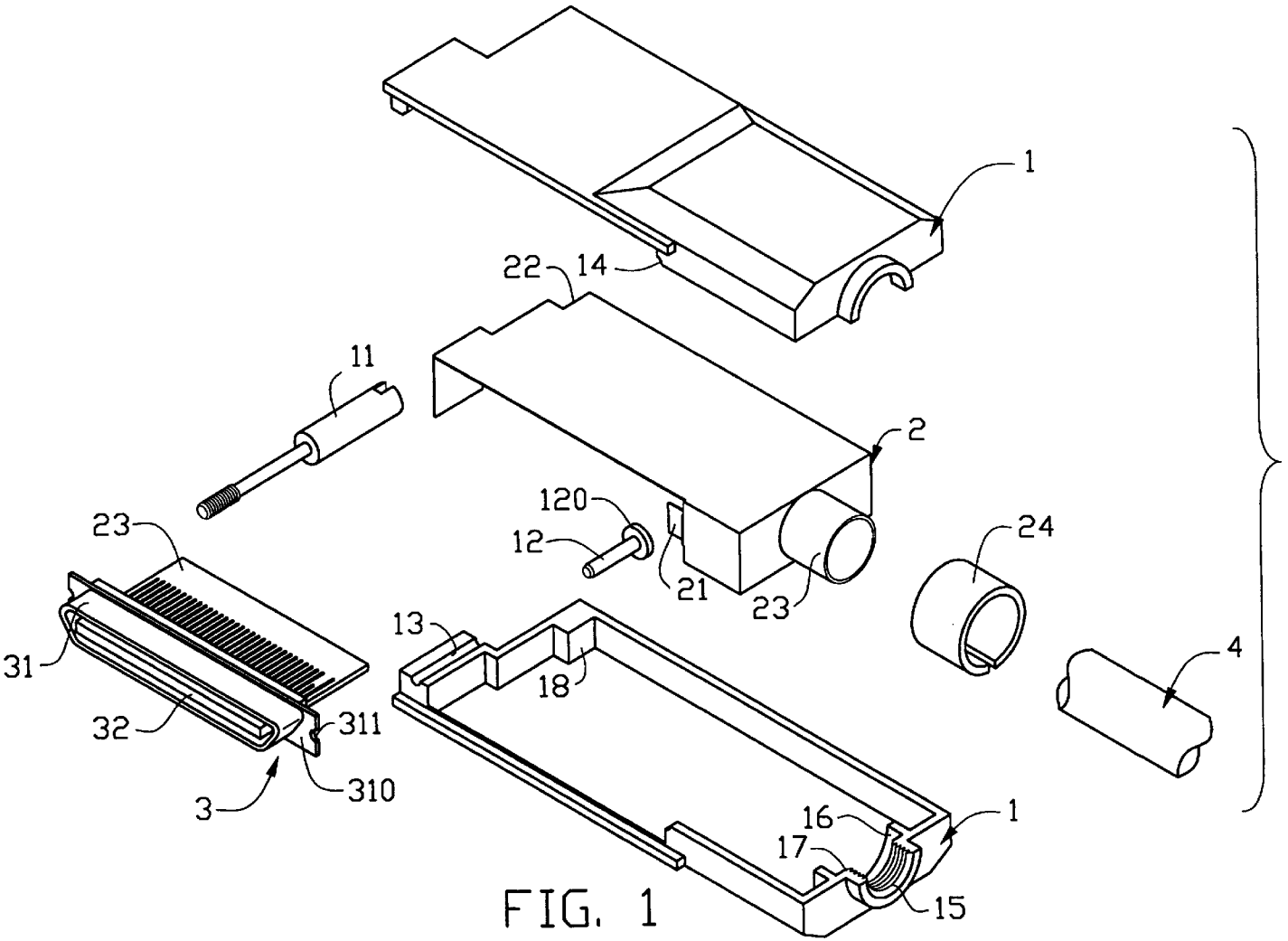
FIG. 1 is an exploded view of a cable end connector constructed in accordance with the present invention.
Figure 2:
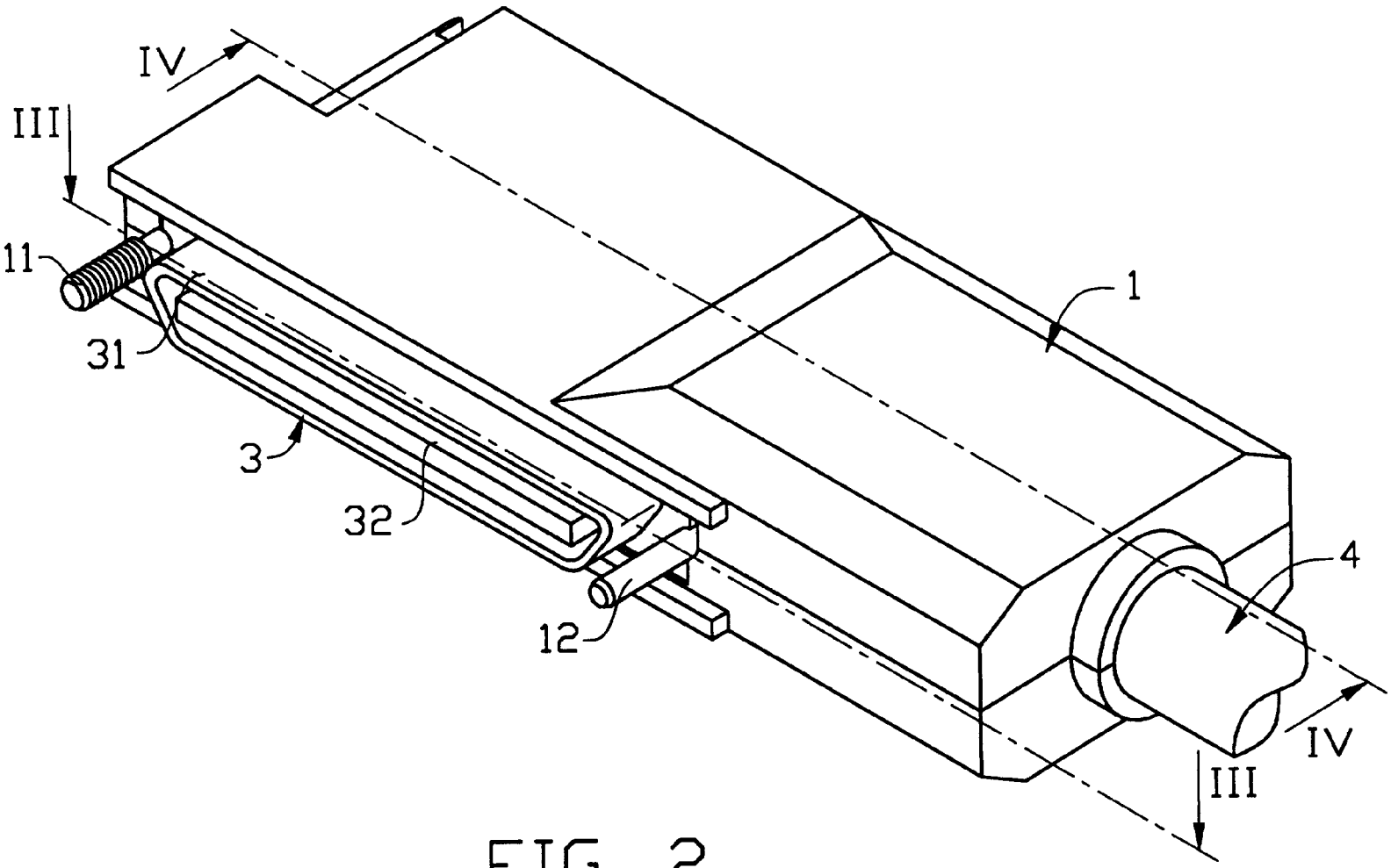
FIG. 2 is an assembled view of FIG. 1.

Referring to the drawings and in particular to FIGS. 1 and 2, a cable end connector constructed in accordance with the present invention comprises an insulative outer casing 1 having an upper casing member 19 and a lower casing member 10 connected together to define an interior space therebetween. The casing 1 defines an opening 100 in a side wall 101 thereof. A connector body 3 is received and retained in the interior space of the outer casing 1 and exposed through the opening 100 for engaging with a mating connector (not shown).

Figure 3:
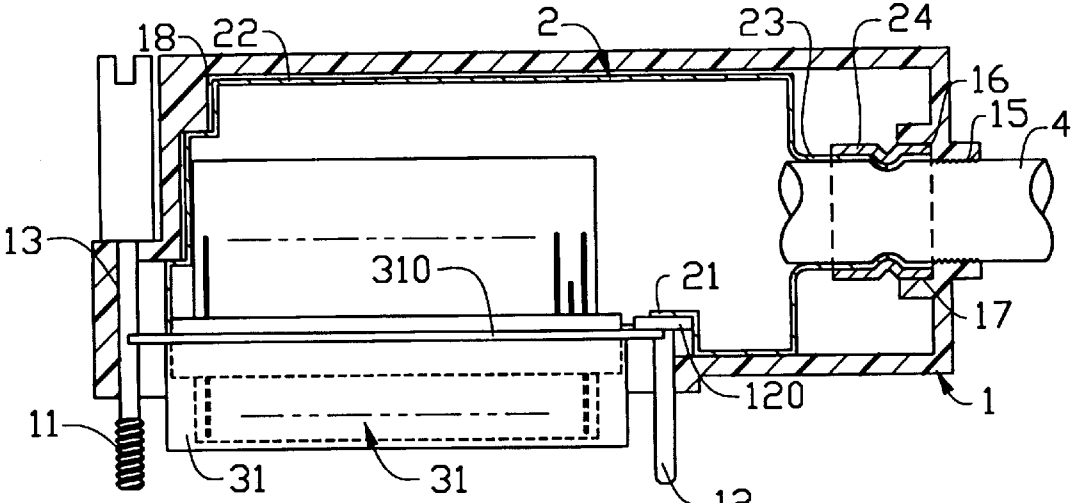
FIG. 3 is a cross-sectional view taken along line III—III of FIG. 2.

A metallic inner casing 2 is received in the interior space of the outer casing 1. The inner casing 2 has opposite side walls 22, 20. A cylinder 23 extends from the side wall 20 of the inner casing 2. A collar 24 is fit over the cylinder 23 of the inner casing 2. The collar 24 is received and retained in a bore 16 defined in an inside face 180 of the side wall 101 (FIG. 3). The bore 16 has a bottom 17 with which an axial end of the collar 24 abuttingly engages. The side wall 22 of the inner casing 2 abuts against an opposite inside face 18 of the side wall 101 of the outer casing 1. The engagement between the inner casing 2 and the inside face 18 of the outer casing 1 and the bottom 17 of the bore 16 securely fixes the inner casing 2 in the outer casing 1 in the horizontal direction as shown in FIG. 3.

Figure 4:
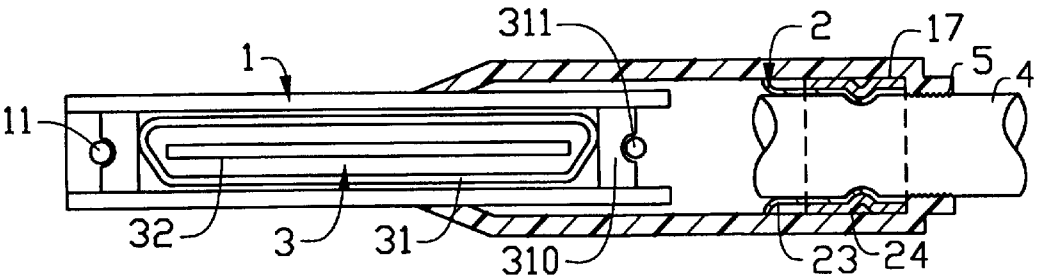
FIG. 4 is a cross-sectional view taken along line IV—IV of FIG. 2.

Furthermore, the side walls 20, 22 of the inner casing 2 have a height substantially equal to a vertical dimension of the interior space of the outer casing 1 between the upper and lower casing members 19, 10 thereby securely fixing the inner casing 2 in the outer casing 1 in the vertical direction as shown in FIG. 4.

Also referring to FIGS. 3 and 4, a leading end of a cable 4 is received in the cylinder 23 of the inner casing 2. The collar 24 and the cylinder 23 are inwardly deformed permanently for surrounding and pinching the leading end of the cable 4 in the cylinder 23. The cable 4 extends beyond the outer casing 1 through a hole 15 defined in the side wall 101 thereof. Preferably, the hole 15 is provided with inwardly-extending teeth or inner threading for engaging with and securely retaining the cable 4.

The connector body 3 comprises a mating section 31 receiving and retaining a number of contact elements 32 therein. The mating section 31 has a circumferential flange 310 supported by the side wall 101 of the outer casing 1. A circuit board 33 is fixed to the mating section 31 in electrical engagement with the contact elements 32. The circuit board 33 is also electrically connected to the leading end of the cable 4. The flange 310 of the connector body 3 defines a first semi-circular notch 311 at a first end (not labeled) thereof. A second semi-circular notch 14 is defined in the side wall 101 of the outer casing 1 corresponding to the first notch 311 to form a hole through which a positioning pin 12 extends. The positioning pin 12 has an expanded end 120 which is retained between the side wall 101 and a supporting tab 21 formed on the inner casing 2 for fixing the positioning pin 12 with respect to the outer casing 1.

A third semi-circular notch 312 is defined in the flange 310 of the connector body 3 at a second end (not labeled) thereof. Corresponding thereto, the outer casing 1 defines a groove 13 therein. The third notch 312 of the flange 310 of the connector body 3 and the groove 13 of the outer casing 1 together form a hole through which a second pin 11 extends. The second pin 11 has an enlarged actuation head and an opposite threaded end 110 extending beyond the flange 310 of the connector body 3 for threadingly engaging with a corresponding means, such as a screw hole, of the mating connector thereby securing the cable end connector to the mating connector. The groove 13 supports the rotation of the second pin 11 therein during engagement with the mating connector.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A cable end connector comprising:

an insulative outer casing defining an interior space therein, said outer casing having a side wall defining an opening, and a front wall defining a hole, both the opening and the hole being in communication with the interior space;

a connector body retaining contact elements therein and being adapted to engage with a mating connector, the connector body being received and retained in the interior space and exposed through the opening of the insulative outer casing;

a cable having a leading end extending into the interior space of the outer casing through the hole to electrically connect with the contact elements;

a positioning pin extending through the side wall at one side of the opening and being adapted to be inserted into a hole defined in the mating connector for properly positioning the cable end connector with respect to the mating connector; and a single fastener having a threaded end adapted to threadedly engage with the mating connector to secure the cable end connector to the mating connector, the threaded end extending through the side wall at a pin side of the opening.

2. The cable end connector as claimed in claim 1 further comprising a metallic inner casing securely fixed in the outer casing, a portion of the cable being fixed to the inner casing.

3. The cable end connector as claimed in claim 2, wherein the cable is fixed to the inner casing by permanently deforming the inner casing.

4. The cable end connector as claimed in claim 3, wherein the inner casing comprises a cylinder for receiving the portion of the cable, the cylinder being inwardly deformed to secure the cable therein.

5. The cable end connector as claimed in claim 4, wherein inwardly-extending teeth are formed on an inner surface of the hole of the outer casing for engaging with and securely retaining the cable therein.

6. The cable end connector as claimed in claim 5, wherein the inwardly-extending teeth comprise inner threading.

7. The cable end connector as claimed in claim 5, wherein the outer casing has opposite inside faces, one of said inside faces being the inside face of the front wall defining the hole, a bore being defined in the inside face of the front wall coaxial with the hole and having a bottom for receiving the cylinder of the inner casing with the cylinder abutting against the bottom, a side wall of the inner casing opposite the cylinder being engaged by the other inside face of the outer casing thereby securely fixing the inner casing inside the outer casing.

8. The cable end connector as claimed in claim 4 further comprising a collar fit over the cylinder of the inner casing, wherein the outer casing has opposite inside faces, one of said inside faces being the inside face of the front wall defining the hole, a bore being defined in the inside face of the front wall coaxial with the hole and having a bottom for receiving the cylinder of the inner casing with the cylinder abutting against the bottom, a side wall of the inner casing opposite the cylinder being engaged by the other inside face of the outer casing thereby securely fixing the inner casing inside the outer casing.

9. The cable end connector as claimed in claim 1 further comprising a circuit board fixed to the connector body in electrical connection with the contact elements thereof, the leading end of the cable being connected to the circuit board.

10. A cable end connector comprising:

an insulative outer casing defining an interior space therein, said outer casing having a side wall defining an opening, and a front wall defining a hole, both the opening and the hole being in communication with the interior space;

a connector body retaining contact elements therein and being adapted to engage with a mating connector, the connector body received and retained in the interior space and exposed through the opening of the insulative outer case;

a cable having a leading end, the leading end extending through the hole into the interior space of the outer case and electrically connected to the contact elements of the connector body;

a positioning pin extending through the side wall at one side of the opening and being adapted to be inserted into a hole defined in the mating connector for properly positioning the cable end connector with respect to the mating connector;

a single fastener having a threaded end adapted to threadedly engage with the mating connector to secure the cable end connector to the mating connector, the threaded end extending through the side wall at a side of the opening opposite to the positioning pin; and an inner casing being securely fixed inside the outer casing and comprising a cylinder securely fixing a portion of the cable, said cylinder being permanently and inwardly deformed to form an inward projection engaging with the cable, thereby resisting an external force transmitted through the cable and protecting interior parts of the cable end connector.

11. The cable end connector as claimed in claim 10, wherein inwardly-extending teeth are formed on an inner surface of the hole of the outer casing for engaging with and securely retaining the cable therein.

12. The cable end connector as claimed in claim 10, wherein the outer casing has opposite inside faces, one of said inside faces being the inside face of the front wall defining the hole, a bore being defined in the inside face of the front wall coaxial with the hole and having a bottom for receiving the cylinder of the inner casing with the cylinder abutting against the bottom, a side wall of the inner casing opposite the cylinder being engaged by the other inside face of the outer casing thereby securely fixing the inner casing inside the outer casing.

13. The cable end connector as claimed in claim 10 further comprising a collar fit over the cylinder of the inner casing, wherein the outer casing has opposite inside faces, one of said inside faces being the inside face of the front wall defining the hole, a bore being defined in the inside face of the front wall coaxial with the hole and having a bottom for receiving the cylinder of the inner casing with the cylinder abutting against the bottom, a side wall of the inner casing opposite the cylinder being engaged by the other inside face of the outer casing thereby securely fixing the inner casing inside the outer casing.

14. A cable end connector comprising:

an insulative outer casing defining an interior space therein, said outer casing having a side wall defining an opening, and a front wall defining a hole, both the opening and the hole being in communication with the interior space;

a connector body being received and retained in the interior space and exposed through the opening;

a plurality of contact elements disposed within said connector body;

a cable having a leading end extending through the hole into the interior space of the outer casing; and only one positioning pin and only one fastener both extending through the side wall respectively at both sides of the opening of in a spatial relation with each other wherein said positioning pin is closer to the leading end of the cable than said fastener, and said fastener includes an actuation head exposed to an exterior outside the casing, thereby resulting in a positioning function by one side of the opening closer to the leading end of the cable, and a latching function by the other side of the opening farther away from the leading end of the cable.

* * * * *